US006604284B1

(12) United States Patent
Kato et al.

(10) Patent No.: US 6,604,284 B1
(45) Date of Patent: Aug. 12, 2003

(54) MANUFACTURING METHOD OF PISTON WITH A HOLLOW SPACE FOR COMPRESSOR

(75) Inventors: Takayuki Kato, Kariya (JP); Takahiro Sugioka, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/713,181

(22) Filed: Nov. 15, 2000

(30) Foreign Application Priority Data

Dec. 1, 1999 (JP) ..... 11-342373

(51) Int. Cl.[7] ..... B23P 15/00

(52) U.S. Cl. ..... 29/888.043; 29/888.042; 29/888.044

(58) Field of Search ..... 29/888.043, 888.044, 29/888.04; 92/260, 172, 186, 155, 159

(56) References Cited

U.S. PATENT DOCUMENTS

| | | | | |
|---|---|---|---|---|
| 3,874,736 A | | 4/1975 | Anderson et al. | 301/63 R |
| 4,482,796 A | | 11/1984 | Weissmann | 219/121 EC |
| 5,174,728 A | | 12/1992 | Kimura et al. | 417/222.2 |
| 6,038,960 A | | 3/2000 | Fukushima et al. | 92/12.2 |
| 6,112,642 A | * | 9/2000 | Jarrett et al. | 29/888.042 |
| 6,155,157 A | * | 12/2000 | Jarrett | 92/186 |
| 6,283,012 B1 | * | 9/2001 | Kato et al. | 92/155 |
| 6,290,439 B1 | * | 9/2001 | Bludis et al. | 408/224 |
| 6,327,962 B1 | * | 12/2001 | Kruse | 92/186 |
| 6,332,394 B1 | * | 12/2001 | Kato et al. | 92/159 |
| 6,339,984 B1 | * | 1/2002 | Sugioka et al. | 92/248 |
| 2001/0027721 A1 | * | 10/2001 | Kato et al. | 92/260 |

FOREIGN PATENT DOCUMENTS

EP 0 959 227 A2 11/1999

OTHER PUBLICATIONS

EP 00 12 5460 Search Report dated May 6, 2002.

* cited by examiner

*Primary Examiner*—I Cuda Rosenbaum
(74) *Attorney, Agent, or Firm*—Woodcock Washburn LLP

(57) ABSTRACT

A method of manufacturing a piston for a compressor and a piston manufacturing machine, with which a hollow piston that can remain light while in operation after being built into a compressor can be produced, are provided. A piston assembly 51 comprising a body part and cup parts is accommodated in a housing recess 50 of a cassette jig 48 and are conveyed. When the cassette jig 48 is positioned just under a welding chamber 45, the housing recess 50 communicates with the welding chamber 45 and is isolated from the outside air by a sealing material 53. The pressure in the welding chamber 45 is reduced to nearly a vacuum by an exhaust pump 46, and electron beam welding is applied to the coupling portion 67 of the piston assembly 51 in a near vacuum atmosphere. After the electron beam welding, a hollow space 68 in the piston assembly is sealed hermetically and contains a near vacuum atmosphere.

5 Claims, 4 Drawing Sheets

MANUFACTURING METHOD OF PISTON WITH A HOLLOW SPACE FOR COMPRESSOR

BACKGROUND OF THE INVENTION

1. Field of the Invention

The present invention relates to a method of manufacturing hollow pistons such as, those used for compressors and a piston manufacturing machine.

2. Description of the Related Art

Weight reduction of a piston, which is to be used in a compressor driven by the reciprocating motion of the piston, is an important technical problem. Particularly in a swash plate compressor of a variable displacement type, the inertia force of a reciprocating piston caused by the reciprocating motion of the piston has a considerable influence on the inclination angle of the swash plate (that is, the control of discharge capacity). Therefore, in order to improve the control of the inclination angle of a swash plate, weight reduction of a piston, to reduce the piston inertia, is required.

Under these circumstances, various piston structures aiming at the weight reduction of a piston, used for a swash plate compressor, have been proposed. For example, a single-headed piston has been disclosed in Japanese Unexamined Patent Publication (Kokai) No. 9-105380, and Japanese Unexamined Patent Publication (Kokai) No. 11-107912. The single-headed piston has a hollow space inside the piston, which is inserted into each cylinder bore of a compressor, and a communication opening through which the hollow space communicates with the outside (a crank chamber, for example). By employing these structures, weight reduction of a piston is realized without a considerable decrease in strength of the mechanical structure of the whole piston. The piston is also designed so that lubricant oil (and a small quantity of refrigerant gas) is supplied from the cylinder bore to the crank chamber via the hollow space and the communication opening.

The piston of this type, however, has a problem in that oil adhered to the inner circumferential wall surface in the hollow space of the piston accumulates and it may remain inside the piston. Such accumulated oil may disadvantageously cause an increase in the weight of the piston and the hollow space cannot then achieve its purpose sufficiently.

SUMMARY OF THE INVENTION

With these above-mentioned problems being taken into account, the present invention has been developed. The purpose of the present invention is to provide a manufacturing method, and a piston manufacturing machine for a compressor, in which a hollow piston that can remain light while in use, after it is built into a compressor, can be manufactured efficiently.

To solve the above-mentioned problems, in the first aspect of the present invention, the method of manufacturing a piston for a compressor, in which a hollow piston is manufactured by welding plural piston parts, includes a process of placement in a reduced pressure area, in which a piston assembly is provided with a hollow space internally by assembling said plural piston parts and is placed in a reduced pressure area, and an electron beam welding process is applied to all the coupling portions of the piston assembly so that each of the above-mentioned piston parts are integrated into a unit under a reduced pressure, and the hollow space is formed into a hermetically sealed space the pressure of which is equal to that in the reduced pressure area.

According to the present invention, since the piston assembly is welded by an electron beam in a reduced pressure area, the hollow part (hollow space) in the piston assembly is sealed hermetically and contains a reduced pressure equal to that of a reduced pressure area. This means it is possible that the hollow space in the piston contains a reduced pressure by utilizing the pressure-reduced atmosphere for the electron beam welding. Moreover, lubricant oil does not seep into the hollow space because the hollow space is sealed hermetically. Therefore, the occurrence of accumulation of lubricant oil inside the piston can be avoided and the piston remains light during its reciprocating motion. In addition, because the hollow space of the piston contains little air, corrosion, by oxidation, at the surface of the piston hollow space can be suppressed.

The piston manufacturing machine of the second aspect of the present invention is equipped with an electron beam welding device which welds the coupling portion of the piston assembly by an electron beam with the pressure in the welding chamber being kept low, a conveying guide device attached to the electron beam welding device and equipped with a conveying guide, jigs, which have housing recesses that accommodate the piston assemblies and are positioned in the welding chamber of the electron beam welding device by the conveying guide device, a sealing means to isolate the housing recesses from the outside air when the jig is positioned in the welding chamber of the electron beam welding device and to respectively define the closed space for each housing recess, and a preliminary exhaust mean to preliminarily exhaust the closed space before the jig is positioned in the welding chamber.

According to the present invention, the jig, in which the piston assembly is accommodated in the housing recess, is conveyed to the welding chamber by the conveying guide device, and the closed space defined by a seal mean is preliminarily exhausted by the preliminary exhaust mean before the jig is positioned in the welding chamber. The electron beam welding device welds the piston assembly by electron beam in the reduced pressure area.

The present invention may be more fully understood from the description of the preferred embodiments of the invention set forth below, together with the accompanying drawings.

DESCRIPTION OF THE PREFERRED EMBODIMENTS

An embodiment of the present invention is described below according to FIGS. 1 through 6.

Figure 6:
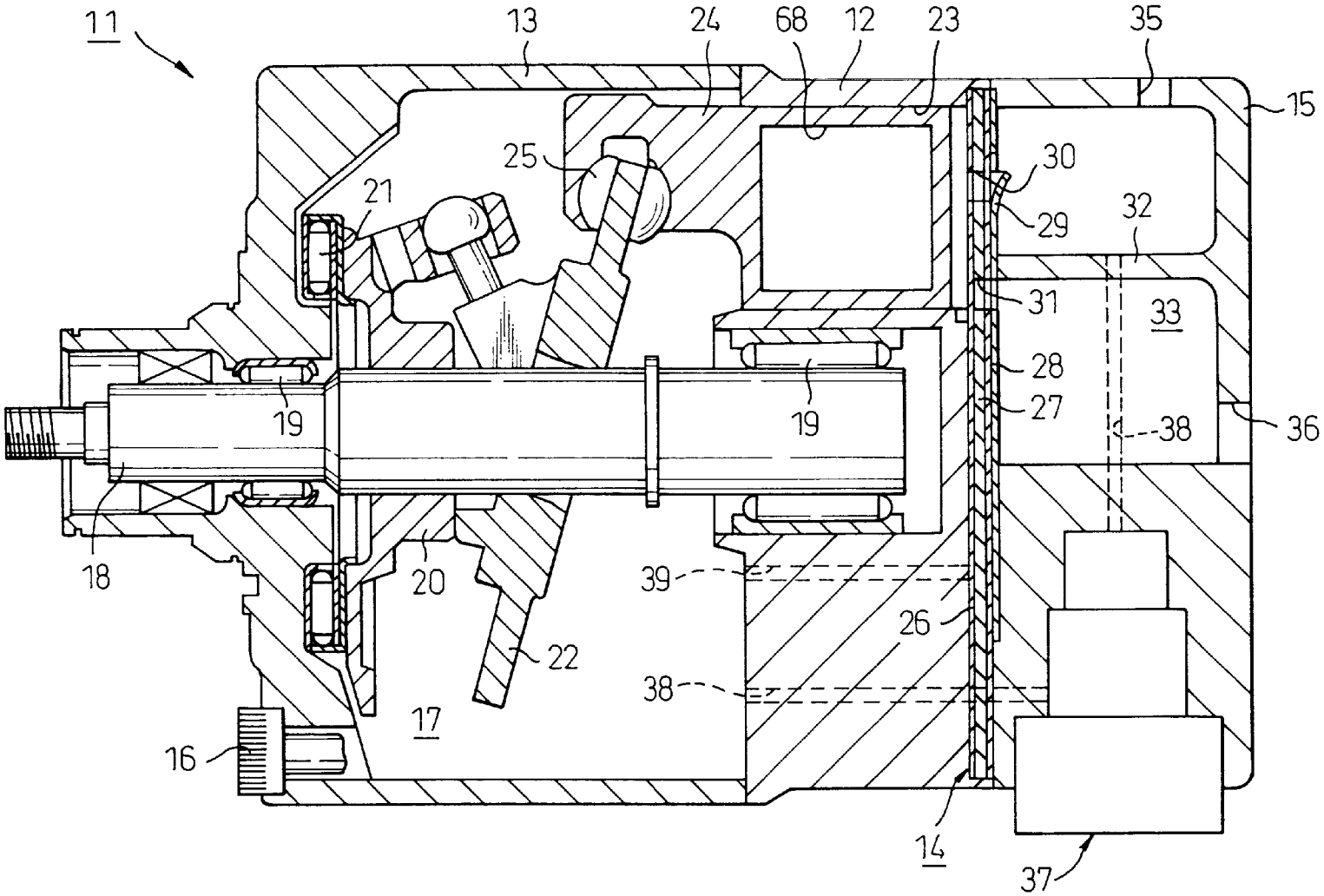
FIG. 6 is a cross-sectional drawing of an oscillating swash plate compressor of a variable displacement type.

As shown in FIG. 6, an oscillating swash plate compressor of a variable displacement type 11 comprises a main housing in which a cylinder block 12, a front housing 13, a valve forming body 14 and a rear housing 15 are coupled and fixed integrally by plural through-bolts 16.

A drive shaft 18 is rotatably supported by plural bearings 19 in a crank chamber 17. The top end of the drive shaft 18 is operatably connected to an external drive source such as an engine (not shown) via means, such as an electromagnetic clutch (not shown).

A rotary support 20 is supported by the inner surface of the front housing 13 via a bearing 21 and rotates together with the drive shaft 18. A swash plate 22 inserted into and supported by the drive shaft 18 is also connected to the rotary support 20, can rotate together with the drive shaft 18 and can move so as to change the inclination thereof with respect to the drive shaft 18.

Single-headed pistons 24 are accommodated in a cylinder bores 23 penetrating through the cylinder block 12 at positions spaced uniformly in the circumferential direction. A piston 24 has a hollow space internally. The proximal end of the piston 24 is connected to the swash plate 22 via shoes 25, and the piston 24 reciprocates axially back and forth as the rotary motion of the swash plate 22 is converted to a reciprocating motion.

The valve forming body 14 comprises a suction valve plate 26, a valve plate 27, a discharge valve plate 28, and a retainer plate 29. A discharge port 30 and a suction port 31 are formed, in the valve forming body 14, at two locations facing the cylinder bore 23.

A suction chamber 33 and a discharge chamber 34 are defined, with a partition 32 located therebetween, in the rear housing 15. A discharge outlet 35 that communicates between the discharge chamber 34 and the outside is formed on the circumferential wall of the rear housing 15. In addition, a suction outlet 36 that communicates between the suction chamber 33 and the outside is formed on the end wall of the rear housing 15.

A control valve 37 arranged in the rear housing 15 is interposed in a pressure supply path 38 that communicates between the crank chamber 17 and the discharge chamber 34. A pressure release passage (throttle passage) 39 also communicates between the crank chamber 17 and the suction chamber 33. The discharge capacity of a variable displacement type compressor 1 can be controlled by the adjustment of the inclination angle of the swash plate 22 due to the control of the pressure (crank pressure) in the crank chamber 17 by adjustment of the opening degree of the control valve 37. When the crank pressure is increased, the inclination angle of the swash plate 22 decreases, and the discharge capacity decreases because of the reduction in stroke of the piston 24, and on the contrary, when the crank pressure is decreased, the inclination angle of the swash plate increases, the stroke of the piston 24 increases and so does the discharge capacity.

The piston manufacturing machine used for the manufacture of a single-headed piston is described next.

Figure 1:
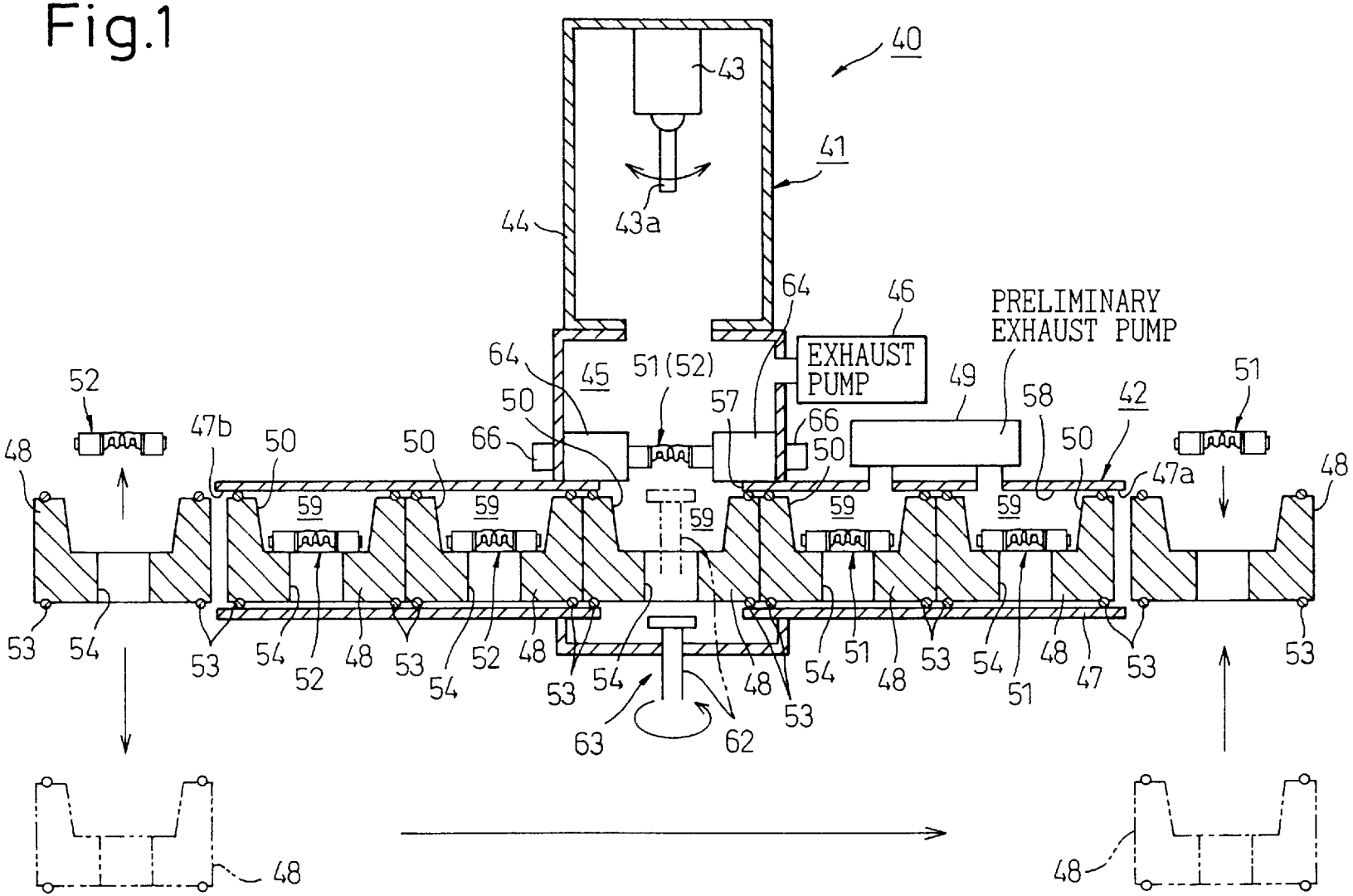
FIG. 1 is an approximate sectional drawing of the piston manufacturing machine in one embodiment.

FIG. 1 is a schematic showing an outline view of a piston manufacturing machine 40. As shown schematically, the piston manufacturing machine 40 is equipped with an electron beam welding device 41 and a conveying guide device 42. The electron beam welding device 41 is equipped with a main body 44 having an electron gun 43, a welding chamber 45 defined inside of the main body 44, and an exhaust pump 46 used as an exhaust means and connected to the welding chamber 45. The welding chamber 45 is a compartment in which the electron beam welding is performed, and the internal pressure is reduced by the exhaust pump 46 to a high degree of vacuum so that electron beam welding can be performed. The electron gun 43 is designed to be able to change the direction of a muzzle 43*a* according to an object to be welded (piston assembly 51).

The conveying guide device 42 comprises a conveying guide tube 47 (referred to briefly as guide tube hereinafter) attached to the main body 44 as a conveying guide, cassette jigs 48 inserted into the inside of the guide tube 47, and a preliminary exhaust pump 49, as a preliminary exhaust means, connected to the conveying passage of the guide tube 47 so that it communicates with the inside of the tube. Plural cassette jigs 48 are loaded in the guide tube 47 and pushed therein from an entrance 47*a* to the right in the drawing by a pushing machine (not shown) and ejected from an outlet 47*b* to the left.

Figure 2:
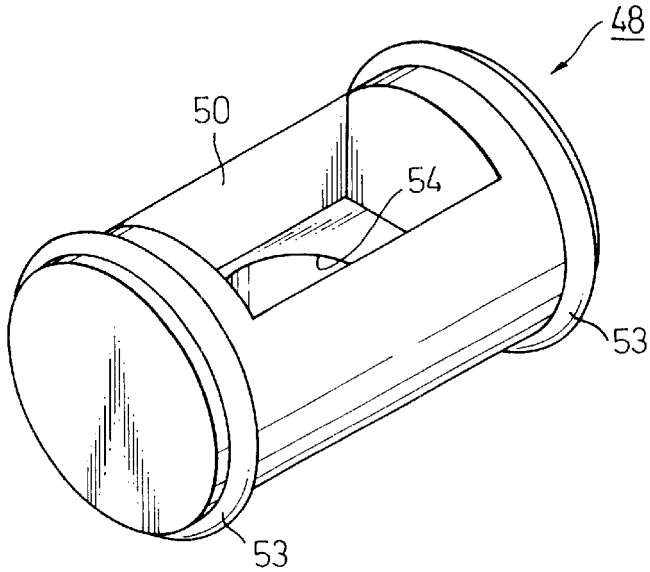
FIG. 2 is an oblique drawing of the cassette jig.

As shown in FIG. 2, the cassette jig 48 is nearly cylindrical and a housing recess 50 is formed in the center of the top surface thereof. The housing recess 50 accommodates a piston assembly 51 (refer to FIG. 1) before it is welded in the welding chamber 45, or a piston welded body 52 (refer to FIG. 1) after the piston assembly 51 is welded. Sealing materials 53 are attached to the outer circumferential surface of the cassette jig 48 as a sealing means at the positions before and behind (before and behind in the conveying direction) of the housing recess 50. A through-hole 54 that penetrates the center of the bottom of the housing recess 50 is formed at the lower portion of the cassette jig 48. Sealing materials 53 make the housing recess 50 for each cassette jig 48 into an independent closed space 59 under a condition in which the welding chamber 45 is packed into the guide tube 47.

Figure 3:
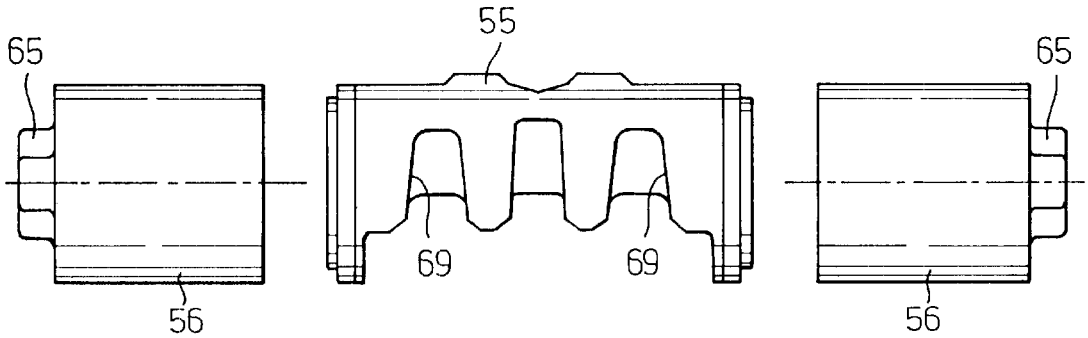
FIG. 3 is a front elevation drawing of the piston parts.

As shown in FIG. 3, the piston assembly 51 comprises a body part 55 and cup parts 56 as piston parts. The piston assembly 51 is assembled by coupling the two cup parts 56 to the both sides of the body part 55 and has a double structure for manufacturing two pistons, in which two single-headed pistons 24 opposing each other are arranged on a common axis (each of the two piston heads are arranged to the leftmost and rightmost sides) so as to be connected integrally.

As shown in FIG. 1, the guide tube 47 has a length sufficient to hold plural (five in this example) cassette jigs 48, and is formed into a nearly cylindrical shape with the inner diameter corresponding to the outer circumferential shape of the cassette jig 48. The guide tube 47 is equipped with an opening 57 that communicates with the welding chamber 45 just under the electron beam welding equipment 41. The five cassette jigs 48 packed into the guide tube 47 are conveyed in a manner that these five cassette jigs are pushed in by a pushing device (not shown) at a pitch equal to the length of the cassette jig 48 so that the middle cassette jig (the third one from the entrance) is located just under the welding chamber 45 (where the welding work takes place). In a situation in which each cassette jig 48 is packed into the guide tube 47, the housing recess 50 thereof is defined as an independent closed space 59 as the two sealing materials 53 installed in the two locations before and behind the outer circumferential surface of each cassette jig 48 are hermetically attached to the inner circumferential surface 58 of the guide tube 47.

The cassette jig 48, in the housing recess 50 of which the piston assembly 51 is set, is conveyed from an entrance 47*a* of the guide tube 47. While the cassette jigs 48 are in two positions (first or second position from the entrance) before reaching the welding work position just under the welding chamber 45, each closed space 59 defined in the guide tube 47 is designed to communicate with the preliminary exhaust pump 49. In the process the cassette jig 48 is being conveyed, each closed space 59 is exhausted both gradually and preliminarily by the preliminary exhaust pump 49, and the pressure of each closed space 59 is reduced, for example, to $10^{-3}$–$10^{-4}$ torr (approx. $133\times10^{-3}$–$133\times10^{-4}$ pascals).

The housing recess 50 of the cassette jig 48 arranged in the welding work position is communicated with the welding chamber 45 via the opening 57 of the guide tube 47, and is isolated from the outside air and the closed spaces 59 of other cassette jigs 48 adjacently positioned before and behind the jig by the two sealing materials 53 attached to the outer circumferential surface thereof. The exhaust pump 46 reduces the inner pressure of the welding chamber 45 to a pressure of a near vacuum, for example, $10^{-4}$–$10^{-5}$ torr (approx. $133\times10^{-4}$–$133\times10^{-5}$ pascals).

Opposing the through-hole 54 of the cassette jig 48 placed in the welding work position, an elevating device 63 equipped with an elevating table 62 is arranged. When the table 62 moves up through the through-hole 54, the piston assembly 51 accommodated in the housing recess 50 is brought up, on the upper surface of said table, to the position for the welding in the welding chamber 45, and the piston welded body 52 after welding is placed on the upper surface of the table 62 again and the piston welded body 52 is accommodated in the housing recess 50 by moving the table 62 down.

A pair of chucks 64 is provided in the welding chamber 45 and the chucks 64 pinch and hold the piston assembly 51 elevated by the table 62 by chucking protrusions 65 (shown in FIG. 5) on the both sides of the piston assembly 51. The pair of chucks 64 is equipped with mechanisms which are driven by each motor 66 and rotate synchronously around the center axis that connects two chucking points. The protrusions 65 of the piston assembly 51 are positioned on the center axis of the cup parts 56, and the piston assembly 51 rotates around the center axis, as the rotation center, in the circumferential direction when the pair of chucks 64 rotates synchronously.

The electron gun 43 is able to change the direction of the muzzle 43*a* thereof so that the electron beam focuses on the top portion of the coupling portion 67 of the piston assembly 51 held by the pair of chucks 64. Electron beam welding is performed on the circumference of the coupling portion 67 while the top portion of the coupling portion 67 is being irradiated with the electron beam and the piston assembly 51 rotates in the circumferential direction in accordance with the synchronous and rotary motion of the pair of chucks 64.

A series of steps of manufacturing the single-headed piston 24 using the piston manufacturing machine 40 is described below.

As shown in FIG. 1, the piston assembly 51 (work) assembled integrally from a washed body part 55 and two washed cup parts 56 is set in the housing recess 50 of a cassette jig 48 before the entrance of the guide tube 47. The cassette jigs 48 with works set are in turn pushed into the guide tube 47 by the pushing device. At each stop position in the conveying process, the closed space 59 of the cassette jig 48 accommodating the piston assembly 51 is exhausted preliminarily by the preliminary exhaust pump 49. As a result, the pressure of the closed space 59 of a cassette jig 48 is reduced by the preliminary exhaust, for example, $10^{-3}$–$10^{-4}$ torr before it reaches the welding work position.

Figure 4:
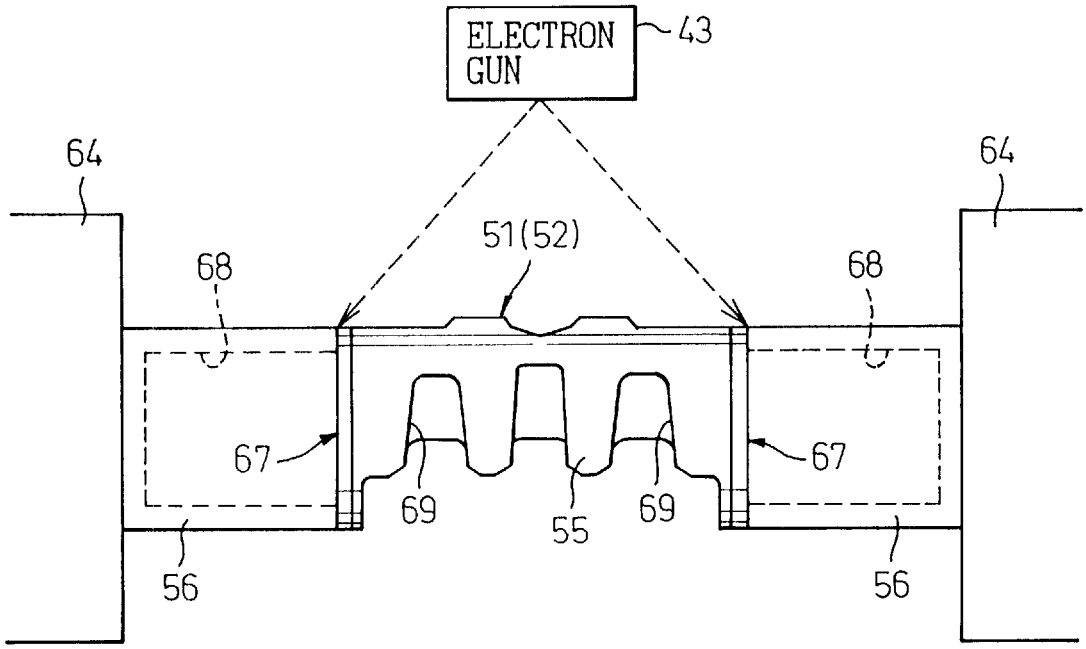
FIG. 4 is a front elevation drawing of the piston assembly clamped by the chucks.

When the cassette jig 48 is conveyed to the welding work position, the elevating device 63 is driven and the table 62 moves up from the level indicated by the solid line and lifts the piston assembly 51 accommodated in the housing recess 50 to the level of the chucks 64. Then the chucks 64 chuck the protrusions 65 on both sides of the piston assembly 51 and pinch and hold both sides of the piston assembly 51 as shown in FIG. 4. In the meanwhile, the pressure in the welding chamber 45 is quickly reduced to $10^{-4}$–$10^{-5}$ torr by the exhaust pump 46. The insides of the cup parts 56, which constitute the piston assembly 51, reach the same degree of vacuum as the welding chamber 45.

After the welding chamber 45 reaches a required degree of vacuum, the electron beam welding is performed on the piston assembly 51 by the electron gun 43 as shown in FIG. 4. The electron beam from the electron gun 43 is radiated to the top portion of the one of the coupling portions 67 of the piston assembly 51 and, while being radiated, the piston assembly 51 rotates in the circumferential direction, for example one turn or more, in accordance with the synchronous and rotary motion of the pair of chucks 64, and the overall circumference of the coupling portion 67 is welded. Since there are two coupling portions on the piston assembly 51, welding is performed sequentially after the direction of the muzzle 43*a* of the electron gun 43 is altered. After the beam welding, a hollow space 68 (refer to FIG. 1), which is a hermetically sealed space in the piston welded body 52, is formed with the same degree of vacuum as the welding chamber 45. During the electron beam welding, the table 62 is waiting at the position indicated by the two-dot chain line as shown in FIG. 1.

After the electron beam welding, the piston welded body 52 (work) is placed on the table 62 and is returned to the housing recess 50 of the cassette jig 48 when the table 62 moves down. Each time one cycle of the welding work is completed, the cassette jigs 48 in the guide tube 47 is conveyed by one pitch, and a cassette jig 48 accommodating the piston welded body 52 is ejected sequentially from the outlet 47*b* of the guide tube 47. Then the piston welded body 52 is taken out from the cassette jig 48 ejected from the outlet 47*b* of the guide tube 47.

Figure 5:
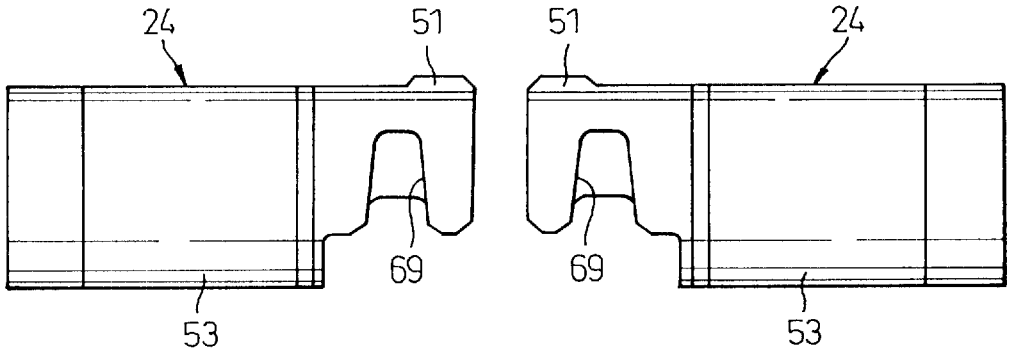
FIG. 5 is a front elevation drawing of the cut and divided piston assembly.

Subsequently, the processing of the machining for the spherical coupling portion 69, to which the shoes 25 are opposed, the cutting process of the protrusions 65, and a surface finish are applied to the piston welded body 52. When these processes are completed, the piston welded body 52 is cut into two parts at the center of the body part 55 as shown in FIG. 5, and two single-headed pistons 24 are produced from a piston welded body 52.

The following effects can be expected in this embodiment.

(1) For the electron beam welding, the welding chamber 45 needs to be nearly a vacuum (a high degree of vacuum). Since the piston assembly 51 is entirely welded in the near vacuum, the hollow space 68 of the piston 24 is a near vacuum and it is possible to efficiently manufacture the piston 24 having a hollow space with little air (oxygen). Because the piston 24 has a hermetically sealed hollow space, the problem of the increased weight of the piston due to the accumulation of lubricant oil in the hollow space can be avoided, and the piston 24 remains light during the operation of the compressor 11. As a result, the ability to control the swash plate angle (that is, the discharge capacity) can be improved. Moreover, corrosion by oxidation in the hollow space of the piston 24 can be avoided.

(2) By the installation of the sealing material 53 on the cassette jig 48, the housing recess 50 can be made a hermetically sealed space isolated from the outside air when the cassette jig 48 arrives at the welding chamber 45. On the other hand, as each closed space 59, in which the piston assembly 51 before welding is installed, is exhausted preliminarily at each stop position in the conveying process, the time required for exhausting during the beam welding can be cut down. Moreover, since the coupling portion 67 to be welded of the piston assembly 51 runs in the circumferential direction, the coupling portion 67 can be entirely welded only by a turn of the piston assembly 51 held by the chucks 64.

(3) Since two single-headed pistons 24 can be manufactured from one piston assembly 51, the productivity of the piston 24 is improved. In addition, the productivity of the compressor 11 is also improved. Moreover, since the piston assembly 51 comprises three parts, that is, a body part 55 and two cup parts 56, welding is required only two portions and the number of welding steps can be reduced.

The embodiments of the present invention are not restricted to those mentioned above. For example, the following modifications are possible.

The preliminary exhaust need not be performed and only the exhaust pump 61 can be used for pressure reduction during welding.

The cassette jig 48 is conveyed one by one, instead of the successive conveyance of the plural cassette jigs 48.

Instead of comprising a body part 55 and two cup parts 56, the piston part can comprise, for example, two cylindrical materials and four lids that cover the ends of the cylindrical materials.

The direction of welding is not restricted to the circumferential direction of the piston assembly 51. For example, the piston assembly may comprise two parts divided in the plane including the center axis line, and the outer circumference of the divided surface of the piston assembly may be welded.

The conveying guide is not limited to the guide tube 47 (cylindrical shape). For example, it is possible to adopt a conveying guide in which a semi-cylindrical upper guide that covers the housing recess 50 of the cassette jig 48 and a semi-cylindrical lower guide that covers the through-hole 54 are arranged facing each other and the cassette jig 48 is conveyed therebetween.

The electron gun 43 is not limited to that of which the direction of the muzzle 43*a* can be changed. An electron beam welding method in which, for example, two electron guns 43 are used and two coupling portions 67 of the piston assembly 51 are welded simultaneously, may be adopted.

Though two single-headed pistons 24 are manufactured from a piston assembly 51 in this embodiment, a piston manufacturing machine 40 that manufactures one single-headed piston 24 at a time may be adopted.

The piston manufacturing machine 40 may not only restrictively manufacture single-headed pistons 24, but also manufacture pistons of other types such as a double-headed type.

The piston manufacturing machine 40 of this example may not only be used to manufacture a piston having a hermetically sealed hollow space, but also can be used to manufacture a hollow piston having an opening that communicates with the outside.

The technical ideas which can be appreciated from the above-mentioned embodiments and other examples, are described below with their effects.

(1) The first aspect of the present invention, includes a cutting process in which the piston assembly, after the application of the electron beam welding, is cut into two single-headed pistons. In this case, two single-headed pistons are produced from a piston assembly, resulting in an improvement in the productivity of the piston.

(2) In the first aspect of the present invention, the piston assembly has a double structure, in which two single-headed pistons are arranged on a common axis facing opposite directions, comprises three piston parts and has a coupling portion in the circumferential direction for each part with a hollow space. In this case, the electron beam welding is easy to perform because the welding direction is along the circumference, only two portions need to be welded, and two single-headed pistons can be manufactured from one piston assembly.

As explained in detail above, according to the present invention, a hollow piston, which can remain light during operation, after being built into the compressor, can be manufactured efficiently.

While the invention has been described by reference to specific embodiments chosen for the purposes of illustration, it should be apparent that numerous modifications could be made thereto by those skilled in the art without departing from the basic concept and scope of the invention.

What is claimed is:

1. A method of manufacturing a piston, for a compressor, in which a hollow piston is manufactured by welding plural piston parts, comprising:

assembling plural piston parts into a piston assembly comprising an internal hollow space;

placing the piston assembly into a reduced pressure area; and performing electron beam welding on all coupling portions of the piston assembly so that each of the piston parts are integrated into a unit under the reduced pressure, and the hollow space forms a hermetically sealed space which is at a pressure equal to that in the reduced pressure area, wherein the step of placing the piston assembly into a reduced pressure area further comprises steps wherein:

a jig having a housing recess that can accommodate the piston assembly is used;

the jig is brought and placed by a conveying guide to a position in which the housing recess of the jig communicates with a welding chamber of an electron beam welding device; and a sealing means is provided to isolate the housing recess, which communicates with the welding chamber, from the outside air.

2. A method of manufacturing a piston for a compressor, as set forth in claim 1, wherein:

the electron beam welding device is equipped with a conveying guide that conveys plural jigs;

the jig has a shape so that it can be inserted into the conveying guide, as well as being equipped with the sealing means;

the housing recess forms an independent closed space with the help of the sealing means when the jig is inserted into the conveying guide; and a preliminary exhaust means is provided that can selectively exhaust the closed space formed for each jig when the jig is positioned at each stop position in the conveying process until the jig is conveyed to the position where it communicates with the welding chamber.

3. A method of manufacturing a piston for a compressor, as set forth in claim 1, wherein the piston is a single-headed piston used for an oscillating swash plate compressor of a variable displacement type.

4. A method of manufacturing a piston for a compressor, as set forth in claim 3, wherein the piston assembly has a double structure in which the two single-headed pistons are integrated into a unit where they are arranged on a common axis and face opposite directions.

5. A method of manufacturing a piston, for a compressor, in which a hollow piston is manufactured by welding plural piston parts, comprising:

assembling plural piston parts into a piston assembly comprising an internal hollow space;

placing the piston assembly into a reduced pressure area; and performing electron beam welding on all coupling portions of the piston assembly so that each of the piston parts are integrated into a unit under the reduced pressure, and the hollow space forms a hermetically sealed space which is at a pressure equal to that in the reduced pressure area, wherein the piston is a single-headed piston used for an oscillating swash plate compressor of a variable displacement type, and wherein the piston assembly has a double structure in which two single-headed pistons are integrated into a unit where they are arranged on a common axis and face opposite directions.

* * * * *